US010438765B2

(12) United States Patent
Jeong et al.

(10) Patent No.: US 10,438,765 B2
(45) Date of Patent: Oct. 8, 2019

(54) FIELD EMISSION DEVICE WITH GROUND ELECTRODE

(71) Applicant: ELECTRONICS AND TELECOMMUNICATIONS RESEARCH INSTITUTE, Daejeon (KR)

(72) Inventors: Jin Woo Jeong, Daejeon (KR); Yoon Ho Song, Daejeon (KR); Jun Tae Kang, Daejeon (KR); Jae Woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 276 days.

(21) Appl. No.: 14/943,996

(22) Filed: Nov. 17, 2015

(65) Prior Publication Data

US 2016/0148776 A1 May 26, 2016

(30) Foreign Application Priority Data

Nov. 21, 2014 (KR) ..... 10-2014-0163860
Sep. 8, 2015 (KR) ..... 10-2015-0127062

(51) Int. Cl.

| | |
|---|---|
| ***H01J 35/04*** | (2006.01) |
| ***H01J 29/46*** | (2006.01) |
| ***H01J 3/02*** | (2006.01) |
| ***H01J 35/06*** | (2006.01) |

(52) U.S. Cl.
CPC ..... *H01J 35/045* (2013.01); *H01J 3/021* (2013.01); *H01J 29/462* (2013.01); *H01J 35/065* (2013.01); *H01J 2203/0292* (2013.01)

(58) Field of Classification Search
CPC ..... H01J 35/065; H01J 29/484; H01J 29/488; H01J 19/24; H01J 2235/06; H01J 2235/0802; H01J 2237/038; H01J 3/027; H01J 3/021; H01J 35/06; H01J 35/08;
(Continued)

(56) References Cited

U.S. PATENT DOCUMENTS 4,899,354 A * 2/1990 Reinhold ..... H01J 35/06 378/113
6,476,340 B1 * 11/2002 Hill ..... H01J 3/027 219/121.15

(Continued)

FOREIGN PATENT DOCUMENTS

JP 4476090 B2 9/2010
KR 10-2002-0035621 A 5/2002

(Continued)

*Primary Examiner* — Brooke Purinton

(57) ABSTRACT

Provided herein is a field emission device. The field emission device includes a cathode which is connected to a negative power supply and emits electrons, an anode which is connected to a positive power supply and includes a target material receiving the electrons emitted from the cathode, and a ground electrode which is formed to face the anode and has an opening through which the electrons emitted from the cathode pass. The ground electrode is grounded so that when an arc discharge occurs due to high voltage operation of the anode, electric charge produced by the arc discharge is emitted to a ground.

14 Claims, 10 Drawing Sheets

(58) Field of Classification Search
CPC .. H01J 2235/068; H01J 35/025; H01J 35/045; H01J 2329/96
See application file for complete search history.

(56) References Cited

U.S. PATENT DOCUMENTS

| | | | | |
|---|---|---|---|---|
| 2002/0168050 | A1* | 11/2002 | Ochiai | H01J 3/028 378/119 |
| 2004/0004588 | A1* | 1/2004 | Kawase | G09G 3/22 345/74.1 |
| 2005/0194887 | A1* | 9/2005 | Ahn | H01J 3/021 313/495 |
| 2006/0066217 | A1 | 3/2006 | Son | |
| 2006/0238104 | A1* | 10/2006 | Lin | H01J 31/127 313/495 |
| 2010/0133980 | A1 | 6/2010 | Jeong et al. | |
| 2011/0286581 | A1* | 11/2011 | Sprenger | H01J 35/04 378/113 |
| 2012/0250827 | A1 | 10/2012 | Jeong et al. | |
| 2014/0346975 | A1 | 11/2014 | Jeong et al. | |
| 2015/0124934 | A1* | 5/2015 | Gupta | A61B 6/40 378/122 |
| 2015/0230766 | A1* | 8/2015 | Wang | A61B 6/4417 600/411 |
| 2015/0282774 | A1* | 10/2015 | Lee | A61B 6/032 378/8 |

FOREIGN PATENT DOCUMENTS

| | | | |
|---|---|---|---|
| KR | 10-2003-0048062 | A | 6/2003 |
| KR | 10-2003-0074605 | A | 9/2003 |
| KR | 10-2008-0017241 | A | 2/2008 |
| KR | 10-2012-0111895 | A | 10/2012 |
| WO | WO 02/31857 | A1 | 4/2002 |

* cited by examiner

FIELD EMISSION DEVICE WITH GROUND ELECTRODE

CROSS-REFERENCE TO RELATED APPLICATION

The present application claims priority to Korean patent application numbers 10-2014-0163860 filed on Nov. 21, 2014 and 10-2015-0127062 filed on Sep. 8, 2015, the entire disclosure of which is incorporated herein in its entirety by reference.

BACKGROUND

Field of Invention

Various embodiments of the present disclosure relate to a field emission device.

Description of Related Art

As shown in FIG. 1, field emission devices include at least two electrodes and are configured such that a field emission emitter which is provided on a relatively-low-potential electrode (typically, a cathode) of the at least two electrodes.

In a field emission device 100 according to a conventional technique shown in FIG. 1, electrons are emitted from a cathode 110, which has relatively low potential, and attracted to an anode 120.

In field emission devices having a diode structure, the quantity of emitted electrons and acceleration energy of electrons cannot be independently controlled. Therefore, field emission devices generally use a triode structure having an additional gate electrode 130, as shown in FIG. 1.

In the triode field emission device 100, the quantity of electrons emitted from the cathode 110 emitted from the cathode 110 is determined by a potential difference between the gate 130 and the cathode 110 (generally, voltage of the gate 130 in the case where the cathode 110 is grounded). Emitted electrons pass through an opening 131 formed in the gate 130 and are attracted to the anode 120. Acceleration energy of electrons is determined by a potential difference between the anode 120 and the cathode 110.

The field emission device 100 typically uses energy of electrons that are emitted and accelerated. Particularly, in the case of an X-ray source which requires high acceleration energy of electrons, the voltage of the anode 120 is relatively high. In this case, as shown in FIG. 2, an arc discharge may occurs due to dielectric breakdown of the anode electrode 120, the gate electrode 130 or between the anode electrode 120 and the cathode electrode 110. Particularly, if an arc discharge is caused on the gate electrode 130 by high voltage atmosphere of the anode 120, the voltage of a power supply connected to the gate 130 may be instantaneously increased. This induces a strong electric field on the field emission emitter and thus may damage the field emission emitter. In addition, if an arc discharge directly influences the cathode 110, the emitter, etc. which are present on the cathode 110 may be damaged. Given this, it is preferable that the diameter of the opening 131 of the gate 130 is less than double the distance between the gate 130 and the cathode 110.

SUMMARY

Various embodiments of the present disclosure are directed to a field emission device which has a stable structure such that a field emission emitter can be protected even under conditions in which a high voltage anode is used.

One embodiment of the present disclosure provides a field emission device including: a cathode connected to a negative power supply and emitting electrons; an anode connected to a positive power supply and receiving the electrons emitted from the cathode; and a ground electrode formed to face the anode and having an opening through which the electrons emitted from the cathode pass, wherein the ground electrode is grounded so that when an arc discharge occurs due to high voltage operation of the anode, electric charge produced by the arc discharge is emitted to a ground.

DETAILED DESCRIPTION

In the following description of embodiments of the present disclosure, if detailed descriptions of well-known functions or configurations would obfuscate the gist of the present disclosure, the detailed descriptions will be omitted.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

In the present disclosure, the singular forms are intended to include the plural forms as well, unless the context clearly indicates otherwise.

Hereinafter, embodiments of the present disclosure will be described in detail with reference to the accompanying drawings.

Figure 1:
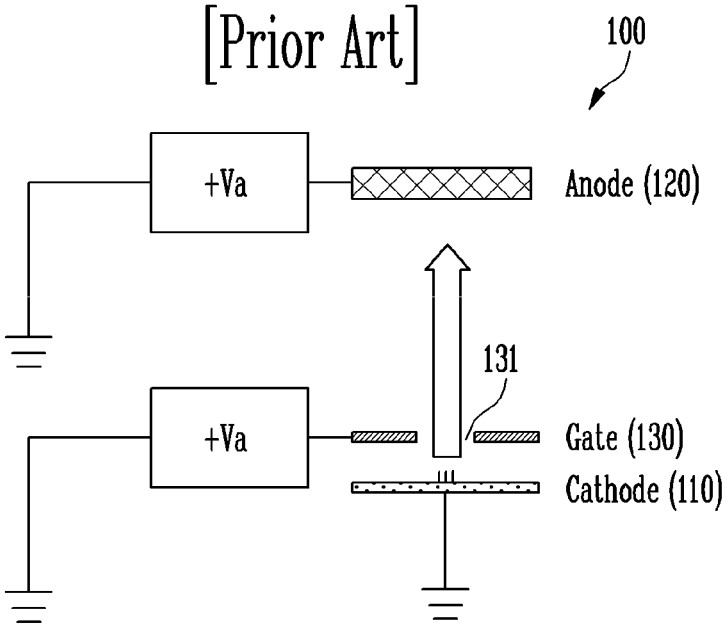
FIG. 1 [Prior Art]
FIG. 1 is a view showing the configuration of a field emission device according to a conventional technique.
Figure 2:
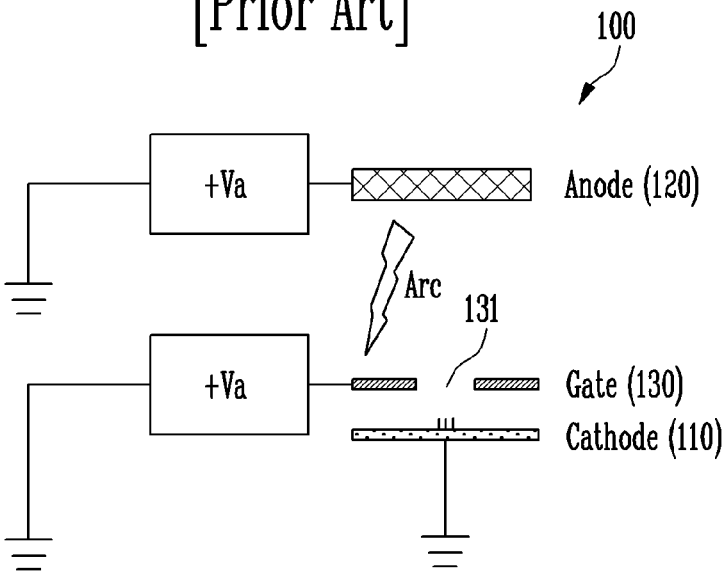
FIG. 2 [Prior Art]
FIG. 2 is a view illustrating an example in which an arc discharge occurs in the field emission device according to the conventional technique.
Figure 3:
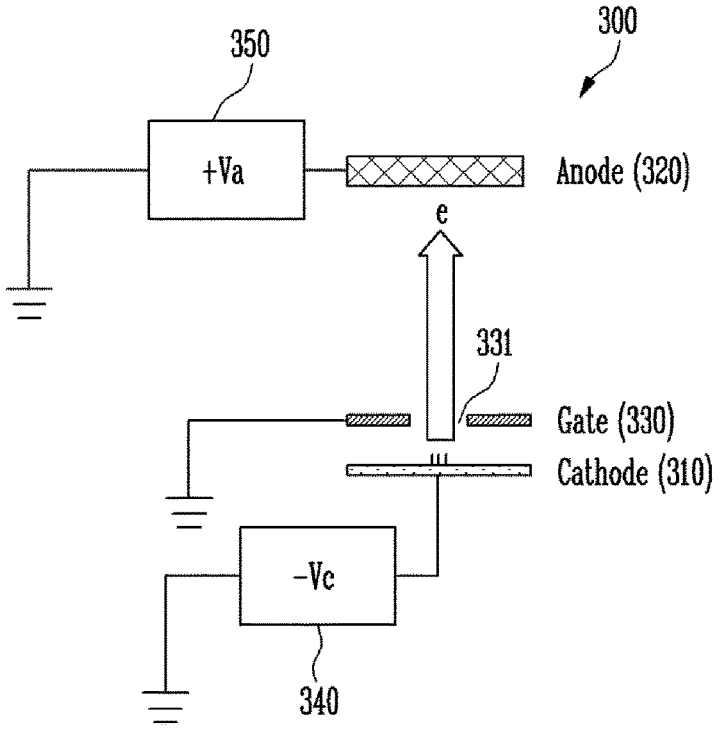
FIG. 3 is a view illustrating the configuration of a field emission device according to a first embodiment of the present disclosure.

FIG. 3 is a view illustrating the configuration of a field emission device according to a first embodiment of the present disclosure.

Referring to FIG. 3, the field emission device 300 according to the first embodiment of the present disclosure includes a cathode 310 which emits electrons, an anode 320 which emits rays when electrons emitted from the cathode 310 collide therewith, and a gate 330 which is formed to face the anode 320 and through which electrons emitted from the cathode 310 pass. The gate 330 may include an opening 331 to allow electrons emitted from the cathode 310 to pass through the gate 330. The anode 320 may include target material which enables the anode 320 to emit rays when electrons emitted from the cathode 310 collide with the anode 320.

In various embodiments of the present disclosure, the cathode 310 is connected to a negative power supply 340, the anode 320 is connected to a positive power supply 350, and the gate 330 is grounded. Hence, the cathode 310 has negative potential, the anode 320 has positive potential, and the gate 330 has zero potential. The gate 330 functions as a ground electrode. In various embodiments of the present disclosure, although the gate 330 is illustrated as an example of the ground electrode facing the anode 320, the present disclosure is not limited to this. That is, the ground electrode may be called various terms, or an electrode performing various functions may be used as the ground electrode.

Generally, if the field emission device 300 is manufactured in such a way that the ground electrode is installed between the high-voltage anode 320 and the low-voltage cathode 310, the field emission device 300 can have high stability. Therefore, as shown in FIG. 3, the field emission device 300 according to the present disclosure is configured such that the electrode facing the anode 320 is grounded, whereby the stability of the field emission device 300 can be enhanced. Here, the ground electrode is provided in a form to face the anode 320. In various embodiments of the present disclosure, the ground electrode may be the gate electrode.

Figure 4:
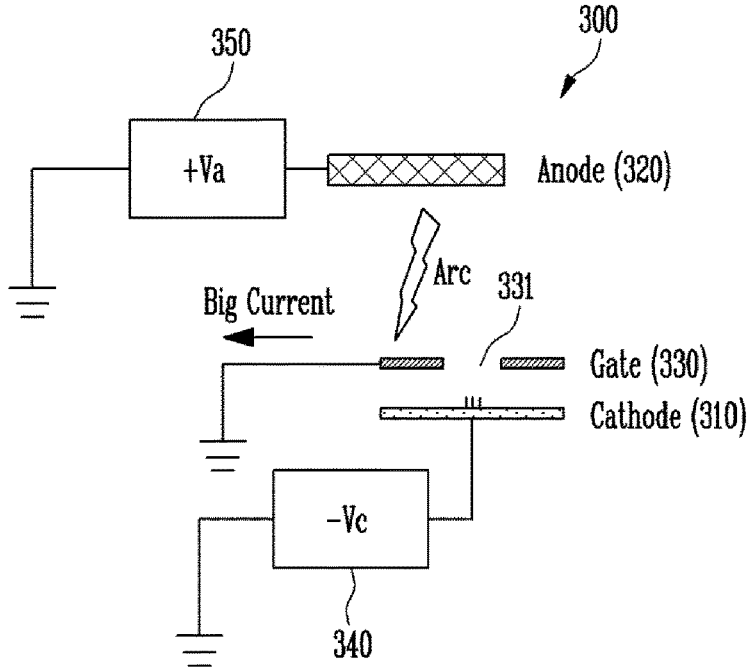
FIG. 4 is a view illustrating an example in which an arc discharge occurs in the field emission device according to the first embodiment of the present disclosure.

In the field emission device 300 according to the present disclosure, even if an arc discharge occurs due to influence of the high-voltage anode 320 and thus a large flow of electric charge is momentarily caused, as shown in FIG. 4, the electric charge is discharged to the ground, and the potential of the gate 330 does not change. Consequently, a field emission emitter can be protected.

Figure 5:
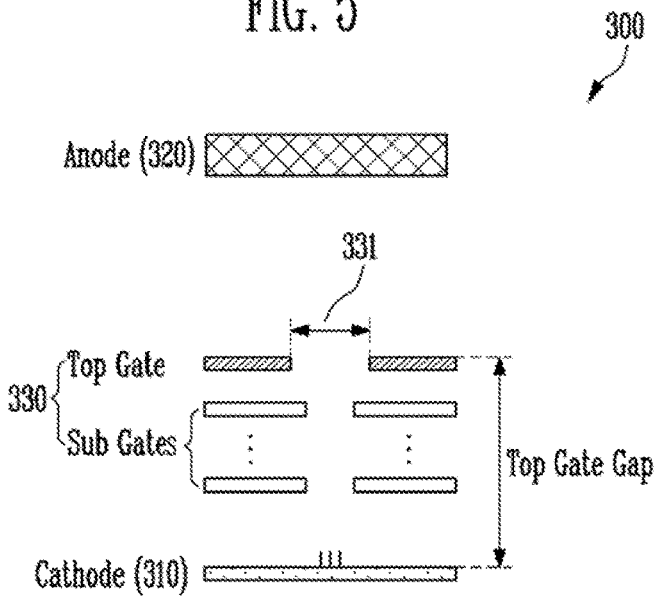
FIG. 5 is a view illustrating an example in which a gate is formed of a plurality of layers in the field emission device according to the first embodiment of the present disclosure.

In various embodiments of the present disclosure, as shown in FIG. 5, the gate 330 may include a plurality of layers. Referring to FIG. 5, in the gate 330 including the multiple layers, a layer that directly faces the anode 320 may be called a top gate (uppermost layer electrode), and remaining layers may be called first to nth sub-gates.

In various embodiments of the present disclosure, the opening 331 of the gate 330 may have a preset diameter based on the distance between the cathode 310 and the gate 330. In the case where the diameter of the opening 331 is comparatively large, when an arc discharge occurs from the high-voltage anode 320, electric charge may be applied to the cathode 310 or other electrodes rather than being discharged to the ground. Therefore, the diameter of the opening 331 of the electrode that faces the anode 320 must have an appropriate size based on the distance between the cathode 310 and the corresponding electrode. In various embodiments of the present disclosure, the opening of the electrode that faces the anode 320 may have a diameter less than double the distance between the cathode 310 and the corresponding electrode. However, this is a criterion corresponding to only one of various embodiments, and the diameter of the opening 331 is preferably set by various experiments to an appropriate size at which electric charge can be most efficiently discharged.

In the present disclosure, the shape of the opening 331 is not limited to a special shape. For instance, the opening 331 may be circular, rectangular, etc.

In various embodiments of the present disclosure, as shown in FIG. 5, in the case where the gate 330 include the multiple layers, the diameter of the opening 331 of the top gate, in other words, the layer that directly faces the anode 320, may have a preset diameter based on the distance between the top gate and the cathode 310. In this case, regardless of the diameter of the opening 331 of the top gate, the opening that is formed in each of the sub-gates may have a larger or smaller diameter.

Figure 6:
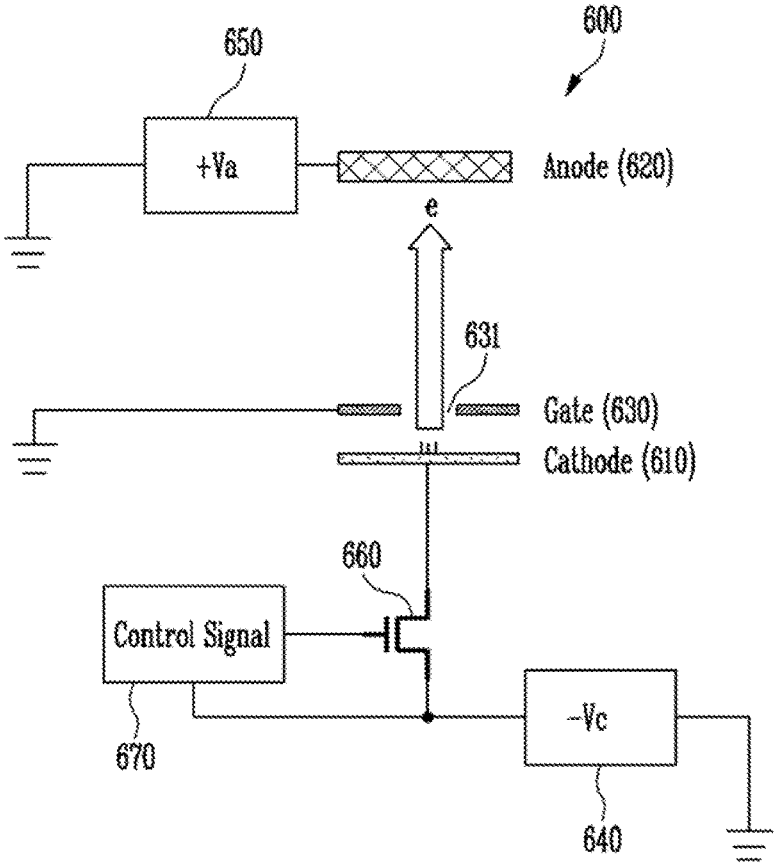
FIG. 6 is a view illustrating the configuration of a field emission device according to a second embodiment of the present disclosure.

FIG. 6 is a view illustrating the configuration of a field emission device according to a second embodiment of the present disclosure.

Referring to FIG. 6, the field emission device 600 according to the second embodiment of the present disclosure includes a cathode 610 which emits electrons, an anode 620 which emits rays when electrons emitted from the cathode 610 collide therewith, and a gate 630 which is formed to face the anode 620 and through which electrons emitted from the cathode 610 pass. The gate 630 may include an opening 631 to allow electrons emitted from the cathode 610 to pass through the gate 630. The anode 620 may include target material which enables the anode 620 to emit rays when electrons emitted from the cathode 610 collide with the anode 620.

In various embodiments of the present disclosure, the cathode 610 is connected to a negative power supply 640, the anode 620 is connected to a positive power supply 650, and the gate 630 is grounded. Hence, the cathode 610 has negative potential, the anode 620 has positive potential, and the gate 630 has zero potential. In the present embodiment, an N-type MOSFET (metal-oxide-semiconductor field-effect transistor) 660 and a control signal source 670 are connected between the cathode 610 and the negative power supply 640.

Figure 7:
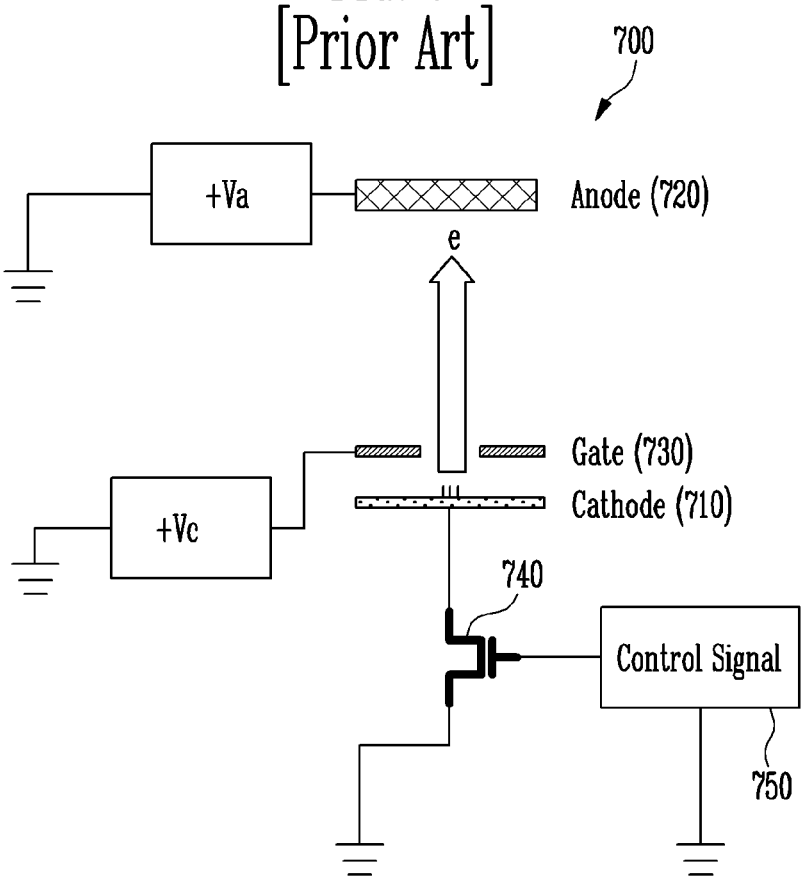
FIG. 7 [Prior Art]
FIG. 7 is a view for explaining a method for controlling cathode current in the field emission device according to the conventional technique.

In a field emission device 700 according to a conventional technique, as shown in FIG. 7, a high-voltage MOSFET 740, etc. are connected in series between a cathode 710 and the ground so as to control current of the cathode 710. Furthermore, in the conventional field emission device according to the conventional technique, a control signal source 750 uses a small signal of 5V or less to control current (field emission current) of the cathode 710.

Figure 8:
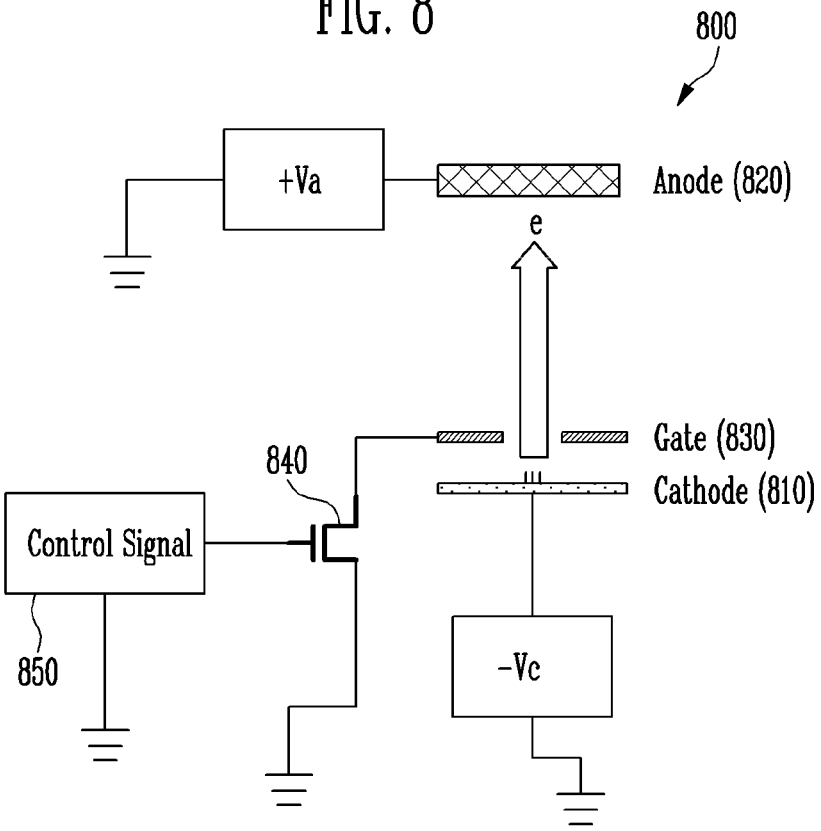
FIG. 8 is a view illustrating an example of application of the method for cathode current of the field emission device according to the conventional technique to the field emission device according to the present disclosure.

If the field emission device 600 according to the present disclosure in which the electrode facing the anode 620 is grounded uses the above-mentioned conventional technique to control current of the cathode 610, as shown in FIG. 8, a P-type MOSFET 840 must be connected between a gate 830 and the ground, and a control signal source 850 must be connected to a gate of the P-type MOSFET 840 so as to control current of the cathode 810. However, in the field emission device 800 shown in FIG. 8, when an arc discharge occurs from a high-voltage anode 820 and thus a large flow of electric charge is applied to the gate 830, the P-type MOSFET 840 or the control signal source 850 may be damaged.

Therefore, in the second embodiment of the present disclosure, the N-type MOSFET 660 and the control signal source 670 are connected between the cathode 610 and the negative power supply 640 to make the field emission device 600 more stable. Here, a drain of the N-type MOSFET 660 is connected to the cathode 610, a source thereof is connected to the negative power supply 640, and a gate thereof is connected to the control signal source 670. A first side of the control signal source 670 is connected to the gate of the N-type MOSFET 660, and a second side thereof is connected to the negative power supply 640 connected to the N-type MOSFET 660. The control signal source 670 inputs, to the gate of the N-type MOSFET 660, a high current control signal based on the negative power supply 640 and thus is able to control current of the cathode 610.

Figure 9:
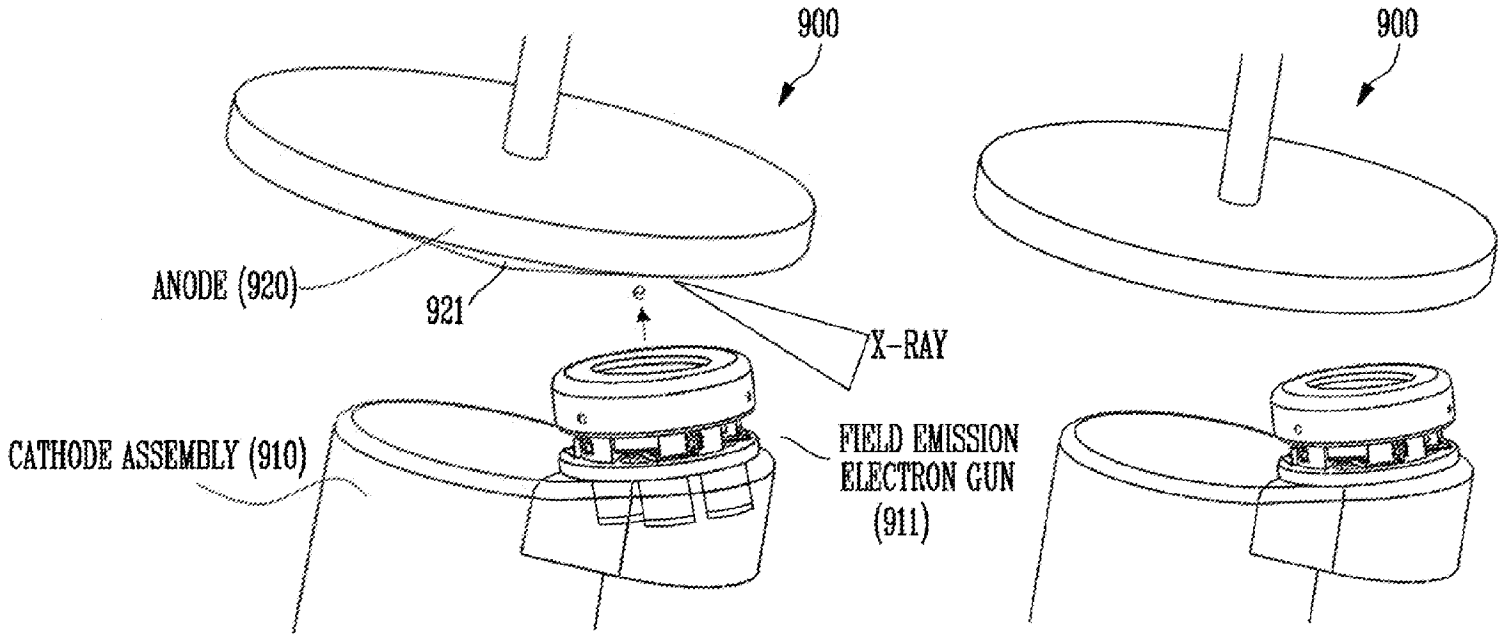
FIG. 9 is a view illustrating the configuration of a field emission device according to a third embodiment of the present disclosure.

FIG. 9 is a view illustrating the configuration of a field emission device according to a third embodiment of the present disclosure.

Referring to FIG. 9, the field emission device 900 according to a third embodiment of the present disclosure includes a cathode assembly 910 provided with a field emission electron gun 911 which emits electrons, and an anode 920 which includes target material 921 which enables the anode 320 to emit rays when electrons emitted from the cathode assembly 910 collide with the anode 920.

Figure 10:
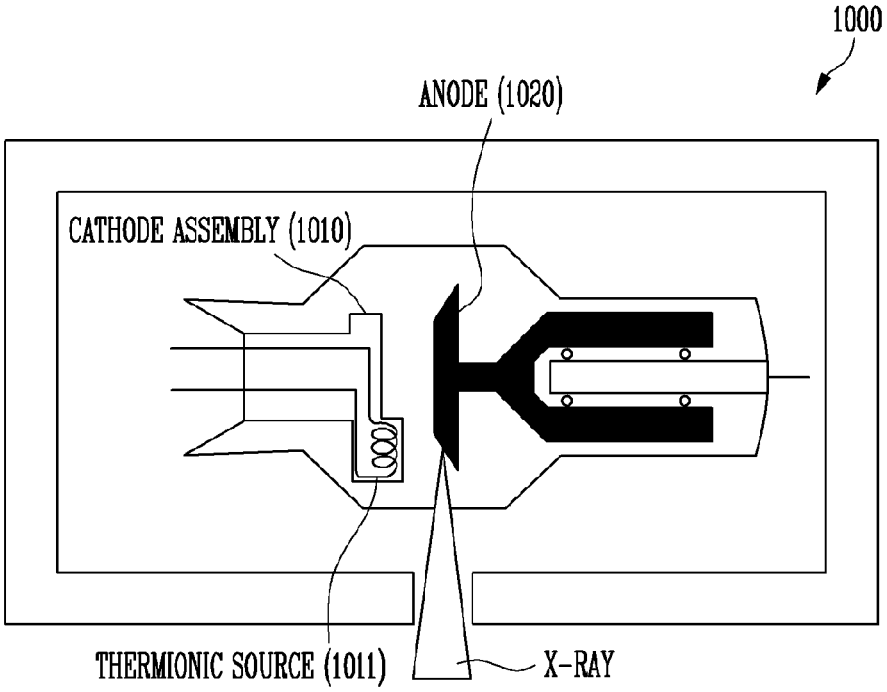
FIG. 10 is a view illustrating an example of an X-ray tube using a thermionic source.

As shown in FIG. 10, in the case of an X-ray tube 1000 using a rotating anode 1020, a thermionic source 1011 of the cathode assembly 1010 functions as an electron emission source to emit X-rays. A field emission source can perform high-speed switching unlike that of the thermionic source 1011. Thus, if the field emission source substitutes for the thermionic source 1011, a high-speed pulse drive X-ray tube 1000 can be embodied. However, it is difficult to commercialize the field emission source because it is vulnerable to high-voltage discharge.

Therefore, in the present disclosure, the field emission electron gun 911 having the structure shown in FIG. 9 is employed to embody the field emission device 900 that can be stably operated even when the high-voltage anode 920 is used.

Hereinbelow, detailed configuration of the field emission electron gun 911 and an assembly method thereof will be described in detail.

Figure 11:
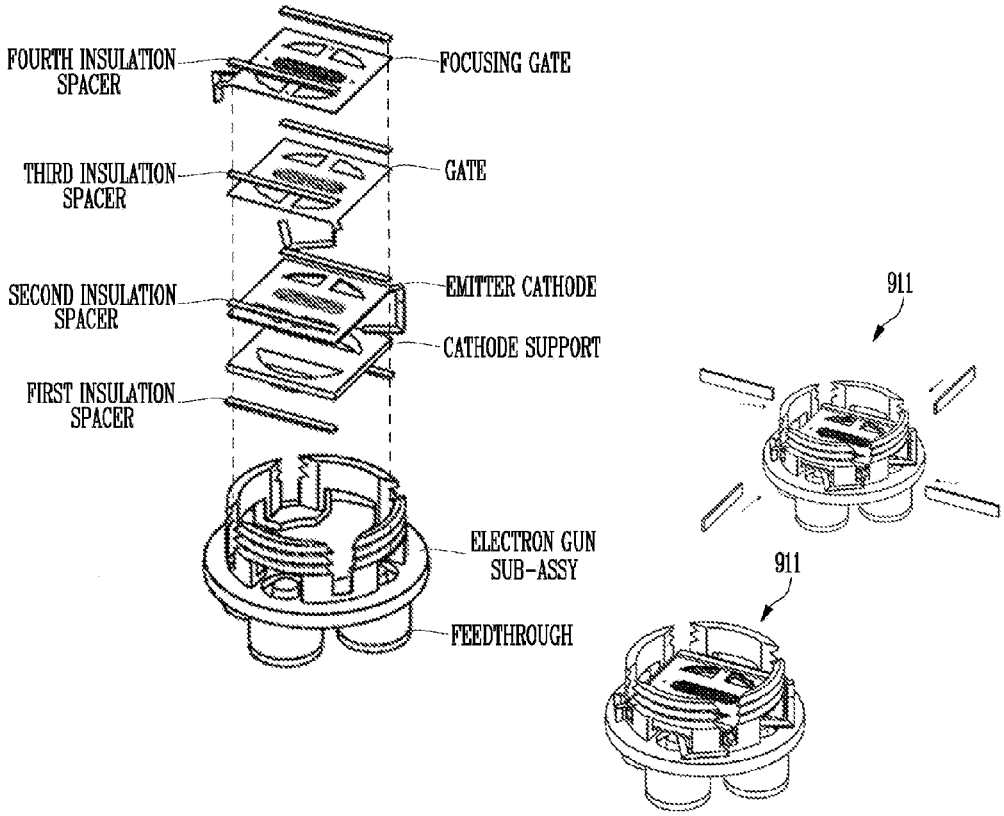
FIGS. 11 and 12 are views illustrating detailed configuration of a field emission electron gun in the field emission device according to the third embodiment of the present disclosure.
Figure 12:
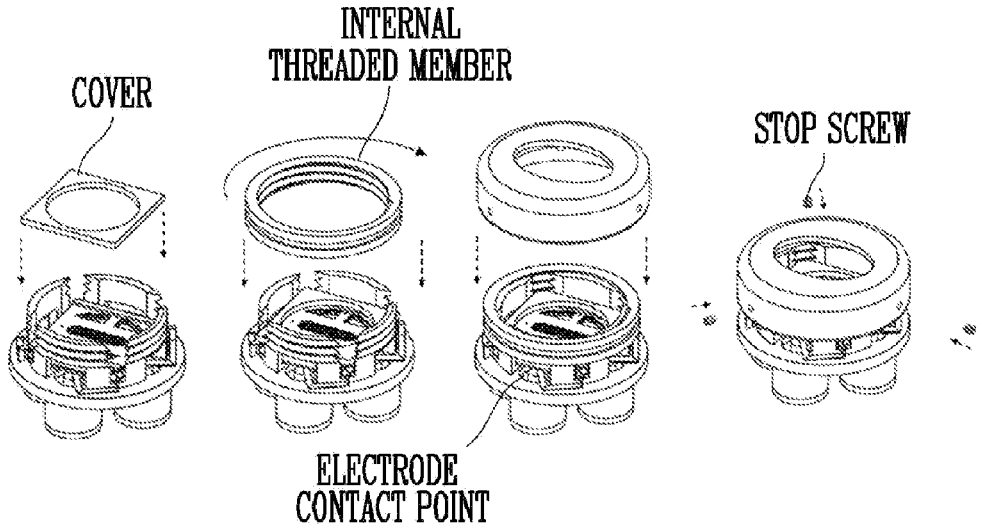

FIGS. 11 and 12 are views illustrating the detailed configuration of the field emission electron gun in the field emission device according to the third embodiment of the present disclosure.

Referring to FIG. 11, the field emission electron gun 911 may include a feedthrough in the bottom thereof. An electron gun sub-assembly is provided on an upper portion of the feedthrough. The electron gun sub-assembly includes an external threaded part. At least one opening may be formed in a portion of a sidewall of the external threaded part such that a portion of an element inserted into the external threaded part is fitted into the opening, whereby the element can be fixed in place.

A plurality of electrodes are stacked on the electron gun sub-assembly, in more detail, inside the external threaded part of the electron gun sub-assembly. In detail, a cathode electrode and a plurality of gate electrodes are stacked on the electron gun sub-assembly. The gate electrode has an opening through which electrons emitted from the cathode pass.

Of the multiple gate electrodes, the gate electrode that is disposed at the uppermost position is an electrode that directly faces the anode and can be called a focusing electrode, a focusing gate or the like. The size of an opening of the focusing electrode is determined depending on the size of an emitter provided on the cathode, the distance between the anode and the cathode, and so forth, as described in the first and second embodiments. The size of the opening of the focusing electrode is a critical factor which determines the size of a focal spot of the X-ray tube. Furthermore, the focusing electrode is grounded, as described in the first and second embodiments of the present disclosure, and thus is able to function to protect the field emission emitter even under conditions in which the high-voltage anode is used.

In various embodiments, insulation spacers may be respectively interposed between the electrodes so as to electrically insulate the electrodes from each other. In various embodiments, the number of stacked gate electrodes may be changed in various manners. Other than the focusing gate, the numbers and shapes of openings formed in the remaining gates may also be changed in various manners. The openings formed in the emitter and the gates that are stacked on top of one another must be precisely aligned with each other.

In the embodiment of FIG. 11, a first insulation spacer, a cathode (emitter cathode) provided with an emitter, a second insulation spacer, a gate having an opening, a third insulation spacer, a focusing gate and a fourth insulation spacer are successively stacked on top of one another.

In an embodiment, as shown in FIG. 11, a cathode support may be provided under a lower end of the emitter cathode so as to prevent the cathode electrode from bending. The cathode support may have a sheet form. Furthermore, an exhaust hole may be formed in each layer of the field emission electron gun 911 to ensure vacuum.

In an embodiment, an additional insulation spacer may be installed on an inner side surface of the external threaded part so as to prevent the electron gun sub-assembly when pushed in the horizontal direction from coming into contact with an inner wall of the field emission device 900 and thus causing a short circuit. The insulation spacer may be inserted into the inner wall of the electron sub-assembly through the opening formed in the sidewall of the external threaded part. As shown in the right portion of FIG. 11, four insulation spacers may be inserted into respective four sides of the inner wall of the lower end of the electron sub-assembly.

A drawing showing the configuration in which all of the electrodes are stacked in the electron gun sub-assembly on the feedthrough is depicted on the bottom of FIG. 11.

After all of the electrodes have been stacked, as shown in FIG. 12, the stacked electrodes are covered with a cover so that the stacked electrodes can be pushed under pressure by the cover and thus fixed in place. A portion of the cover is coupled to the opening formed in the sidewall of the external threaded part of the electron gun sub-assembly so that the cover can be fixed in place. The outer peripheral surface of the cover may have various shapes. In the embodiment of FIG. 12, the cover has a rectangular shape. In this case, four corners of the rectangular cover may be coupled to respective openings formed in portions of the sidewall of the external threaded part.

An internal threaded member is coupled to the external threaded part of the electron gun sub-assembly. When the internal threaded member is tightened over the external threaded part, all of the electrodes can be fixed in place without moving. After the electrodes have been fixed in place, the electrodes are electrically connected to the feedthrough provided under the bottom of the electron gun sub-assembly. Each electrode can be electrically connected to the feedthrough by a method such as spot welding or the like.

As shown in the rightmost portion of FIG. 12, the focusing electrode placed on the electron gun sub-assembly can be fixed to the internal threaded member by stop screws inserted into a side surface of the focusing electrode.

Figure 13:
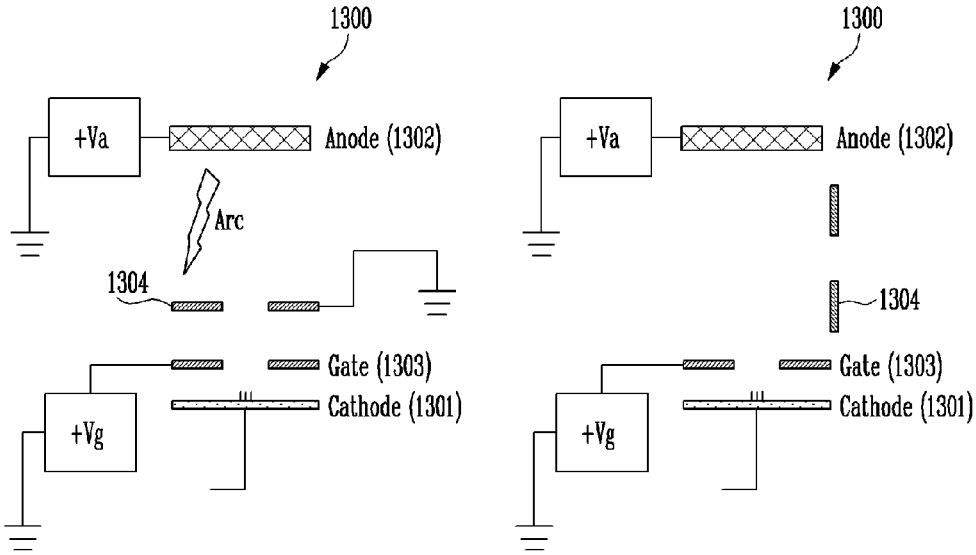
FIG. 13 is a view illustrating a method of applying a principle of the configuration of the field emission device according to an embodiment of the present disclosure to aging.

FIG. 13 is a view illustrating a method of applying a principle of the configuration of the field emission device according to an embodiment of the present disclosure to aging.

Referring to FIG. 13, when aging of a field emission device 1300 is performed, as shown in the left view of FIG. 13, a ground electrode 1304 is installed between an anode 1302 and a gate 1303, thus preventing the emitter from being damaged by high-voltage discharged during the aging process.

After the aging process has been completed, as shown in the right portion of FIG. 13, the ground electrode 1304, which is unnecessary after the aging process, is removed from an electron beam path, and then the field emission device 1300 is used.

In various embodiments, in lieu of installation of the additional ground electrode 1304, the gate 1303 may be grounded during the aging process, and necessary drive voltage may be applied thereto after the aging process has been completed.

As described above, a field emission device according to the present disclosure can have improved stability in operation under high-voltage conditions.

Although exemplary embodiments of the present disclosure have been disclosed, those skilled in the art will appreciate that various modifications, additions and substitutions are possible, without departing from the scope and spirit of the present disclosure. Furthermore, the embodiments disclosed in the present specification and the drawings just aims to help those with ordinary knowledge in this art more clearly understand the present disclosure rather than aiming to limit the bounds of the present disclosure. Therefore, it is intended that all changes which can be derived from the technical spirit of the present disclosure fall within the bounds of the present disclosure.

What is claimed is:

1. A field emission device comprising:

a cathode connected to a negative power supply and emitting electrons;

an anode connected to a positive power supply and receiving the electrons emitted from the cathode;

a plurality of gate electrodes facing the anode and having an opening through which the electrons emitted from the cathode pass, the plurality of gate electrodes including a top gate electrode and a plurality of sub-gate electrodes between the top gate and the cathode;

an N-type metal-oxide-semiconductor field-effect transistor (MOSFET) connected between the cathode and the negative power supply, the N-type MOSFET having a source connected to the negative power supply; and a control signal source connected to a gate of the N-type MOSFET, the control signal source providing a control signal to the gate of the N-type MOSFET and controlling a current of the cathode, wherein the top gate electrode is selectively grounded, and wherein the control signal source comprises a first end connected to the gate of the N-type MOSFET, and a second end directly connected to the negative power source.

2. The field emission device according to claim 1, wherein the opening has a preset diameter depending on a distance between the cathode and the top gate electrode.

3. The field emission device according to claim 1, wherein the opening of the top gate electrode has a diameter less than a predetermined length, the predetermined length being twice as long as a distance between the cathode and the top gate electrode.

4. The field emission device according to claim 1, wherein the cathode comprises an emitter emitting, as an electron beam, the electrons emitted from the cathode.

5. The field emission device according to claim 1, wherein the N-type MOSFET further has a drain connected to the cathode.

6. The field emission device according to claim 1, wherein the cathode and the plurality of gate electrodes are included in a field emission electron gun.

7. The field emission device according to claim 6, wherein the field emission electron gun further includes:

a feedthrough disposed on a bottom of the field emission electron gun; and an electron gun sub-assembly disposed on an upper portion of the feedthrough and comprising an externally threaded part, and wherein the cathode and the plurality of gate electrodes are stacked in the externally threaded part and are electrically connected to the feedthrough.

8. The field emission device according to claim 7, wherein the field emission electron gun further comprises:

a cathode support provided under a lower end of the cathode so as to prevent the cathode from bending.

9. The field emission device according to claim 7, wherein the field emission electron gun further comprises:

a cover covering the cathode and the plurality of gate electrodes that are stacked, the cover being coupled and fixed to an opening formed in a sidewall of the externally threaded part.

10. The field emission device according to claim 7, wherein the field emission electron gun further comprises:

an internally threaded member coupled to the externally threaded part; and a stop screw disposed to pass through the internally threaded member and coupled to a focusing electrode, the focusing electrode being coupled to the internally threaded member.

11. The field emission device according to claim 1, wherein the source of the N-type MOSFET is directly connected to the negative power supply.

12. The field emission device according to claim 1, wherein the source of the N-type MOSFET is directly connected to the negative power supply.

13. The field emission device according to claim 1, wherein the plurality of sub-gate electrodes are grounded.

14. The field emission device according to claim 1, wherein the opening of the plurality of gate electrodes is an opening of the top gate electrode, and each of the plurality of sub-gate electrodes has an opening, the opening of each of the plurality of sub-gate electrodes having a diameter smaller than a diameter of the opening of the top gate electrode.

* * * * *